US010316864B2

(12) United States Patent
Fletcher et al.

(10) Patent No.: US 10,316,864 B2
(45) Date of Patent: Jun. 11, 2019

(54) DEVICES FOR PRODUCING VACUUM USING THE VENTURI EFFECT

(71) Applicants: David E. Fletcher, Flint, MI (US); Brian M. Graichen, Leonard, MI (US); James H. Miller, Ortonville, MI (US); Keith Hampton, Ann Arbor, MI (US)

(72) Inventors: David E. Fletcher, Flint, MI (US); Brian M. Graichen, Leonard, MI (US); James H. Miller, Ortonville, MI (US); Keith Hampton, Ann Arbor, MI (US)

(73) Assignee: Dayco IP Holdings, LLC, Troy, MI (US)

( * ) Notice: Subject to any disclaimer, the term of this patent is extended or adjusted under 35 U.S.C. 154(b) by 24 days.

(21) Appl. No.: 15/097,558

(22) Filed: Apr. 13, 2016

(65) Prior Publication Data

US 2016/0298656 A1 Oct. 13, 2016

Related U.S. Application Data

(60) Provisional application No. 62/146,444, filed on Apr. 13, 2015.

(51) Int. Cl.
*F04F 5/20* (2006.01)
*F04F 5/46* (2006.01)
*F04F 5/52* (2006.01)

(52) U.S. Cl.
CPC ..... *F04F 5/46* (2013.01); *F04F 5/20* (2013.01); *F04F 5/464* (2013.01); *F04F 5/52* (2013.01)

(58) Field of Classification Search
CPC ..... F04F 5/46; F04F 5/20; F04F 5/14; F04F 5/16; F04F 5/464; F04F 5/00; F04F 5/52
See application file for complete search history.

(56) References Cited

U.S. PATENT DOCUMENTS 262,069 A * 8/1882 Mack ..... F04F 5/46 417/151
1,845,969 A 2/1932 Hueber
(Continued)

FOREIGN PATENT DOCUMENTS

CN 2400655 10/2000
CN 1724298 A 1/2006
(Continued)

OTHER PUBLICATIONS

Plastic Vacuum Ejector Generator Pneumatic Fitting ZH07DS (first published at least as early as Dec. 29, 2015).
(Continued)

*Primary Examiner* — Bryan M Lettman
*Assistant Examiner* — Timothy P Solak
(74) *Attorney, Agent, or Firm* — FisherBroyles, LLP; Susan M. Oiler

(57) ABSTRACT

Devices for producing vacuum using the Venturi effect have a housing defining a suction chamber, a motive passageway converging toward the suction chamber, a discharge passageway diverging away from the suction chamber, and a suction passageway in fluid communication with the suction chamber. A solenoid valve is positioned in the suction passageway and has an elongate sealing member received inside a coil, a first seal seat at a first end of the coil, and a second seal seat at the second end of the coil. The elongate sealing member is translatable within the coil between the first seal seat and the second seal seat, which define an open position and a closed position. Within the suction chamber, a motive exit of the motive passageway is generally aligned with and spaced apart from a discharge entrance of the discharge passageway to define a Venturi gap.

20 Claims, 11 Drawing Sheets

(56) References Cited

U.S. PATENT DOCUMENTS 2,037,884 A 4/1936 Day
2,044,088 A * 6/1936 Lord ..... E02F 3/90 209/44
2,183,561 A 12/1939 Hamblin
2,274,276 A 2/1942 Rappl
2,382,391 A 8/1945 Berman
2,396,290 A 3/1946 Schwarz
2,449,683 A 9/1948 Akeman et al.
2,512,479 A 6/1950 Callejo
2,626,009 A 1/1953 Sebok et al.
2,790,595 A 4/1957 Ebner
2,799,467 A * 7/1957 Hedene ..... F16K 27/062 251/124
2,905,268 A 9/1959 McMichael
2,954,091 A 9/1960 McMichael
3,018,799 A * 1/1962 Hartzell ..... F16L 55/045 138/26
3,064,878 A 11/1962 Bayles et al.
3,093,153 A 6/1963 Horowitz
3,145,728 A 8/1964 Pelzer
3,234,932 A 2/1966 Bird et al.
3,236,284 A * 2/1966 Kemper ..... F23N 5/12 340/605
3,239,131 A 3/1966 Whyte
3,430,437 A 3/1969 Saussele et al.
3,581,850 A 6/1971 Jaitl
3,583,842 A * 6/1971 Hancock ..... G01M 3/2876 340/626
3,592,438 A * 7/1971 Greenwood ..... F16K 31/0651 251/174
3,698,510 A 10/1972 Blatt et al.
3,754,841 A 8/1973 Grabb et al.
3,826,281 A 7/1974 Clark
3,842,932 A 10/1974 Gibel
3,921,915 A * 11/1975 Glenn ..... B05B 1/10 239/589
3,923,081 A 12/1975 Persson
4,070,292 A * 1/1978 Adams ..... C02F 3/1242 210/195.1
4,208,921 A 6/1980 Keyes
4,211,200 A 7/1980 Rocchio et al.
4,308,138 A 12/1981 Woltman
4,354,492 A 10/1982 McPhee
4,380,418 A 4/1983 Crawford et al.
4,424,883 A 1/1984 Musiani
4,429,671 A * 2/1984 Surace ..... F02P 5/1553 123/339.11
4,499,034 A 2/1985 McAllister
4,519,423 A 5/1985 Ho et al.
4,554,786 A 11/1985 Takeuchi et al.
4,556,086 A 12/1985 Raines
4,634,559 A 1/1987 Eckert
4,646,482 A * 3/1987 Chitjian ..... B24C 3/065 451/87
4,683,916 A 8/1987 Raines
4,759,691 A 7/1988 Kroupa
4,893,654 A 1/1990 Feuz
4,938,309 A 7/1990 Emdy
4,951,708 A 8/1990 Miller
5,005,550 A 4/1991 Bugin, Jr. et al.
5,069,062 A 12/1991 Malecek et al.
5,087,175 A 2/1992 Raizman et al.
5,108,266 A 4/1992 Hewitt
5,167,046 A * 12/1992 Benson ..... A47L 5/18 15/409
5,188,141 A 2/1993 Cook et al.
5,291,916 A 3/1994 Kloosterman et al.
5,326,942 A 7/1994 Schmid
5,375,621 A 12/1994 Gaehwiler
5,431,346 A 7/1995 Sinaisky
RE35,532 E 6/1997 Duren
5,816,446 A * 10/1998 Steindorf ..... B01F 3/0861 222/1
5,881,759 A 3/1999 Andersson
6,035,881 A 3/2000 Emmerich et al.
6,132,629 A 10/2000 Boley
6,163,239 A * 12/2000 Ozawa ..... F16K 31/0631 251/129.01
6,192,911 B1 2/2001 Barnes
RE37,090 E 3/2001 Kloosterman et al.
6,220,271 B1 4/2001 Emmerich et al.
6,254,315 B1 7/2001 Pfeiffer
6,308,731 B1 10/2001 Kawasaki
6,325,602 B1 12/2001 Rademacher
6,619,322 B1 9/2003 Wojciechowski et al.
6,626,249 B2 9/2003 Rosa
7,029,103 B2 4/2006 Iida
7,100,587 B2 9/2006 Ahlborn et al.
7,353,812 B1 4/2008 Gosdzinski et al.
7,610,140 B2 10/2009 Hirooka
7,628,170 B2 12/2009 Kok-Hiong et al.
7,673,653 B2 3/2010 Mijers et al.
7,722,132 B2 5/2010 Carlsson
7,806,174 B2 * 10/2010 Khomynets ..... E21B 43/124 166/101
7,926,502 B1 4/2011 Lott
8,136,548 B2 3/2012 Trueb
8,147,225 B2 4/2012 Kuny
8,517,056 B2 8/2013 Cullin
8,839,607 B2 9/2014 Pursifull et al.
9,074,523 B2 7/2015 Ulrey et al.
9,133,796 B2 9/2015 Plymale et al.
9,827,963 B2 11/2017 Fletcher et al.
2002/0002997 A1 1/2002 Steinruck et al.
2002/0027041 A1 3/2002 Czabala et al.
2004/0036185 A1 2/2004 Garcia
2004/0094848 A1 5/2004 Lange
2004/0113288 A1 6/2004 Korzeniowski
2005/0045417 A1 3/2005 Ni
2005/0061378 A1 3/2005 Foret
2005/0121084 A1 6/2005 Andersson
2005/0257838 A1 11/2005 Everson
2006/0016477 A1 1/2006 Zaparackas
2007/0044848 A1 3/2007 Norman
2007/0152355 A1 7/2007 Hartley
2008/0007113 A1 1/2008 Choi
2008/0121480 A1 5/2008 Kawamori et al.
2008/0145238 A1 6/2008 Shibayama et al.
2011/0132311 A1 6/2011 Pursifull et al.
2011/0186151 A1 8/2011 Sparazynski
2011/0240753 A1 10/2011 Stevenson et al.
2012/0024249 A1 2/2012 Fuhrmann et al.
2012/0080134 A1 4/2012 Harris et al.
2012/0315559 A1 12/2012 Noh et al.
2013/0139911 A1 6/2013 Wilson et al.
2013/0213510 A1 8/2013 Burnham et al.
2013/0233276 A1 9/2013 Pursifull et al.
2013/0233287 A1 9/2013 Leone
2013/0340732 A1 12/2013 Pursifull et al.
2014/0014080 A1 1/2014 Beshay et al.
2014/0123941 A1 5/2014 Ulrey et al.
2014/0165962 A1 6/2014 Pursifull
2014/0196694 A1 7/2014 Euliss et al.
2014/0197345 A1 7/2014 Graichen et al.
2014/0217679 A1 8/2014 Barrall et al.
2014/0360607 A1 12/2014 Fletcher et al.
2014/0366527 A1 12/2014 Fletcher et al.
2015/0114348 A1 4/2015 Pursifull et al.
2015/0114350 A1 4/2015 Pursifull
2015/0147196 A1 5/2015 Chahal et al.
2015/0158477 A1 6/2015 Luehrsen
2015/0159677 A1 6/2015 Hampton et al.
2016/0010661 A1 1/2016 Fletcher et al.
2016/0040688 A1 2/2016 Fletcher et al.
2016/0265557 A1 * 9/2016 Fletcher ..... F04F 5/20

FOREIGN PATENT DOCUMENTS

CN 201109426 9/2008
CN 201377408 Y 1/2010
CN 201907500 7/2011
CN 103407441 11/2013
CN 203394893 U 1/2014

(56) References Cited

FOREIGN PATENT DOCUMENTS

| | | | | | |
|---|---|---|---|---|---|
| CN | 203485907 | U | | 3/2014 | |
| DE | 3809837 | A1 | | 10/1988 | |
| DE | 4310761 | | | 10/1994 | |
| EP | 0442582 | A1 | | 8/1991 | |
| EP | 0545121 | | | 6/1993 | |
| GB | 190603061 | | | 11/1906 | |
| GB | 1 402 996 | | * | 8/1975 | ..... F02C 7/22 |
| GB | 2110344 | A | | 6/1983 | |
| GB | 2129516 | | | 5/1984 | |
| GB | 2171762 | | | 9/1986 | |
| JP | H01-111878 | U | | 7/1989 | |
| JP | 2001-295800 | | | 10/2001 | |
| JP | 2007-327453 | | | 12/2007 | |
| JP | 2009168134 | | | 7/2009 | |
| JP | 2011-191868 | A | | 9/2011 | |
| WO | 2007/050011 | A1 | | 5/2007 | |
| WO | 2007/078077 | | | 7/2007 | |
| WO | 2008/014306 | A2 | | 1/2008 | |
| WO | 2010054900 | A1 | | 5/2010 | |
| WO | 2014/094890 | A1 | | 6/2014 | |
| WO | 2015/089176 | | | 6/2015 | |

OTHER PUBLICATIONS

Racing Vacuum Pump PE 10000-01; http://www.product-engr.com/vacuum_pump.html (first published at least as early as Feb. 20, 2011).
PCT, International Search Report and Written Opinion, PCT/US2014/041250 (dated Oct. 27, 2014).
PCT, International Search Report and Written Opinion, PCT/US2014/059672 (dated Jan. 9, 2015).
PCT, International Search Report and Written Opinion, PCT/US2015/012018 (dated May 8, 2015).
PCT, International Search Report and Written Opinion, PCT/US2015/024195 (dated Jul. 24, 2015).
PCT, International Search Report and Written Opinion, PCT/US2015/033079 (dated Aug. 21, 2015).
PCT, International Search Report and Written Opinion, PCT/US2015/039950 (dated Oct. 5, 2015).
PCT, International Search Report and Written Opinion, PCT/US2015/043911 (dated Nov. 6, 2015).
PCT, International Search Report and Written Opinion, PCT/US2016/012260 (dated Mar. 16, 2016).
U.S., Non-Final Office Action, U.S. Appl. No. 14/294,727; (dated Oct. 8, 2015).
U.S., Non-Final Office Action, U.S. Appl. No. 14/565,075; (dated Nov. 16, 2015).
U.S., Non-Final Office Action, U.S. Appl. No. 14/509,612; (dated Dec. 18, 2015).
U.S., Non-Final Office Action, U.S. Appl. No. 14/600,598; (dated Feb. 11, 2016).
U.S., Final Office Action, U.S. Appl. No. 14/565,075; (dated Apr. 1, 2016).
U.S., Final Office Action, U.S. Appl. No. 14/294,727; (dated Apr. 22, 2016).
English translation of JP 07-117010, accessed Nov. 9, 2015, <https://www4.j-platpat.inpit.go.jp/cgi-bin/tran_web_cgi_ejje?u=http://www4.j-platpat.inpit.go.jp/eng/translation/20151110030429332207917469 24010100932AF2D1BD4629B19B03A22964BC2FC8>.
U.S., Final Office Action, U.S. Appl. No. 14/509,612; (dated Jun. 22, 2016).
U.S., Non-Final Office Action; U.S. Appl. No. 14/565,075; (dated Jul. 21, 2016).
PCT, International Search Report and Written Opinion, PCT/US2016/027229 (dated Jul. 15, 2016).
CN, Search Report with English translation; Chinese Patent Application No. 201480001422.9; (dated Jul. 20, 2016).
CN, Office Action with English translation; Chinese Patent Application No. 201480001422.9; (dated Aug. 1, 2016).
U.S., Final Office Action; U.S. Appl. No. 14/600,598; (dated Aug. 19, 2016).
U.S., Advisory Action; U.S. Appl. No. 14/509,612; (dated Sep. 1, 2016).
U.S., Notice of Allowance; U.S. Appl. No. 14/509,612; (dated Oct. 17, 2016).
U.S., Notice of Allowance; U.S. Appl. No. 14/600,598; (dated Nov. 10, 2016).
CN, Office Action and Search Report with English translation; Chinese Patent Application No. 201410413220.7; (dated Nov. 14, 2016).
CN, Office Action with English translation; Chinese Patent Application No. 201480001422.9; 19 pages (dated Feb. 16, 2017).
EP, Supplementary European Search Report; Patent Application No. 14811266.7; 5 pages (dated Apr. 5, 2017).
CN, First Office Action and Search Report with English translation; Patent Application No. 2015800003002; 11 pages (dated Apr. 6, 2017).
EP, Extended European Search Report; Patent Application No. 14852220.4, Applicant Dayco IP Holdings, LLC, 6 pages (dated May 10, 2017).
CN, Office Action with English translation; Chinese Patent Application No. 2015800050465, Applicant Dayco IP Holdings, LLC, 7 pages (dated Jul. 4, 2017).
CN, Search Report with English translation; Chinese Patent Application No. 2015800050465, Applicant Dayco IP Holdings, LLC, 4 pages (dated Jul. 4, 2017).
CN Search Report with English Translation, Chinese Patent Application No. 201580042186X (3 pages).
CN, Second Office Action with English Translation, Chinese Application No. 201410413220.7 dated Jul. 18, 2017 (5 pages).
CN, Third Office Action, Supplemental Search Report with English Translation, Chinese Application No. 201410413220.7 dated Jan. 3, 2018 (6 pages).
EP, Search Report, Application No. 15737914.0 filed Jul. 7, 2017 (8 pages).
U.S., Office Action, U.S. Appl. No. 14/796,447 dated Dec. 26, 2017.
U.S., Office Action, U.S. Appl. No. 15/065,470 dated Nov. 16, 2017.
CN, Third Office Action English Translation; Chinese Application No. 201410413220.7 (dated Jan. 17, 2018).
EP, Supplemental Search Report: European Application No. 15818552.0 (dated Mar. 7, 2018).
JP, Non-Final Office Action with English Translation; Japanese Application No. 2016-519556 (dated May 18, 2018).
EP, Supplemental Search Report; European Application No. 15830300.8 (dated May 29, 0218).
U.S., First Office Action; U.S. Appl. No. 15/791,561 (dated Jul. 26, 2018).
CN, First Office Action; Chinese Application No. 201680013143.3 (dated Jul. 31, 2018).
CN, First Office Action Search Report; Chinese Application No. 201680013143.3 (dated Jul. 31, 2018).
U.S., Final Office Action; U.S. Appl. No. 14/796,447 (dated May 11, 2018).
U.S., Office Action; U.S. Appl. No. 151065,470 (dated Mar. 29, 2018).
U.S., Office Action, U.S. Appl. No. 15/065,470 (dated Jul. 9, 2018).
EP, Supplemental Search Report; European Application No. 15752428.7 (dated Jul. 5, 2018).
U.S., Non-Final Office Action; U.S. Appl. No. 15/065,470 (dated Aug. 27, 2018).
JP, Office Action with English Translation; Japanese Application No. 2017-506350 (dated Sep. 12, 2018).
U.S., Non-Final Office Action; U.S. Appl. No. 14/796,447 (dated Sep. 10, 2018).
JP, First Office Action with English Translation; Japanese Application No. 2016-521267 (dated Sep. 11, 2018).
EP, Supplemental Search Report; European Application No. 16780599.3 (dated Dec. 18, 2018).
JP, Second Office Action with English Translation; Japanese Application No. 2017-506350 (dated Feb. 22, 2018).
U.S., Final Office Action; U.S. Appl. No. 14/796,447 (dated Feb. 28, 2018).

(56) References Cited

OTHER PUBLICATIONS

JP, Second Office Action with English Translation; Japanese Application No. 2016-521267 (dated Apr. 5, 2019).

* cited by examiner

DEVICES FOR PRODUCING VACUUM USING THE VENTURI EFFECT

RELATED APPLICATIONS

This application claims the benefit of U.S. Provisional Application No. 62/146,444, filed Apr. 13, 2015, which is incorporated herein by reference.

TECHNICAL FIELD

This application relates to devices for producing vacuum using the Venturi effect, more particularly to such devices having increased suction flow generated with a moderate motive flow rate.

BACKGROUND

Engines, for example vehicle engines, are being downsized and boosted, which is reducing the available vacuum from the engine. This vacuum has many potential uses, including use by the vehicle brake booster.

One solution to this vacuum shortfall is to install a vacuum pump. Vacuum pumps, however, have a significant cost and weight penalty to the engine, their electric power consumption can require additional alternator capacity, and their inefficiency can hinder fuel economy improvement actions.

Another solution is an aspirator that generates vacuum by creating an engine air flow path that is parallel to the throttle, referred to as an intake leak. This leak flow passes through a Venturi that generates a suction vacuum. The problem with the presently available aspirators is that they are limited in the amount of vacuum mass flow rate they can generate, and by the amount of engine air they consume.

A need exists for improved designs that generate an increased suction mass flow rate, in particular when the motive flow is a boosted motive flow.

SUMMARY

Devices are disclosed herein that generate increased suction mass flow rate, in particular, when the motive flow is a boosted motive flow, for example, from a turbocharger or supercharger. The devices for producing vacuum using the Venturi effect have a housing defining a suction chamber, a motive passageway converging toward the suction chamber and in fluid communication therewith, a discharge passageway diverging away from the suction chamber and in fluid communication therewith, and a suction passageway in fluid communication with the suction chamber. Within the suction chamber, a motive exit of the motive passageway is generally aligned with and spaced apart from a discharge entrance of the discharge passageway to define a Venturi gap, and the suction passageway enters the suction chamber at a position that generates about a 180 degree change in the direction of suction flow from the suction passageway to the discharge passageway.

The motive passageway and the discharge passageway both diverge in cross-sectional area away from the suction chamber as a hyperbolic or parabolic function. The motive exit of the motive passageway has a first corner radius inside the motive passageway, and the discharge entrance is generally flush with a wall of the suction chamber and transitions thereto with a second corner radius. The second corner radius is preferably larger than the first corner radius, and the cross-sectional area of the motive exit is smaller than the cross-sectional area of the discharge entrance.

The motive passageway in any of the variations of the devices disclosed herein terminates in a spout protruding into the suction chamber and disposed spaced apart from all one or more sidewalls of the suction chamber, thereby providing suction flow around the entirety of an exterior surface of the spout. The exterior surface of the spout converges toward the outlet end of the motive passageway with one or more converging angles when viewed in a longitudinal cross-section, and the suction chamber has a generally rounded interior bottom below the spout.

In all the various embodiments of the devices, the suction chamber has about a 10 mm to about a 25 mm internal width, and has an electromechanical valve in the suction passageway controlling fluid flow into the suction chamber. The electromechanical valve is preferably a solenoid valve in a normally closed position.

The devices for producing vacuum using the Venturi effect have a housing defining a suction chamber, a motive passageway converging toward the suction chamber and in fluid communication therewith, a discharge passageway diverging away from the suction chamber and in fluid communication therewith, and a suction passageway in fluid communication with the suction chamber. Within the suction chamber, a motive exit of the motive passageway is generally aligned with and spaced apart from a discharge entrance of the discharge passageway to define a Venturi gap, and the motive passageway terminates in a spout protruding into the suction chamber disposed spaced apart from all one or more sidewalls of the suction chamber thereby providing suction flow around the entirety of an exterior surface of the spout.

In all the various embodiments of the devices, the suction passageway is preferably disposed parallel to the discharge passageway, and the exterior surface of the spout converges toward the outlet end of the motive passageway. Also, the motive exit has a first corner radius inside the motive passageway, and the discharge entrance is generally flush with an end wall of the suction chamber and transitions thereto with a second corner radius. The second corner radius is larger than the first corner radius, and the motive passageway and the discharge passageway both diverge in cross-sectional area away from the suction chamber as a hyperbolic or parabolic function. The cross-sectional area of the motive exit is smaller than the cross-sectional area of the discharge entrance, and the suction chamber has a generally rounded interior bottom below the spout.

In all the various embodiments of the devices, an electromechanical valve is disposed in the suction passageway to control fluid flow into the suction chamber. The electromechanical valve is preferably a solenoid valve in a normally closed position.

Also disclosed herein are systems that include any one of the devices for producing vacuum using the Venturi effect, such as those devices described above and below. Also included in the system is a source of boost pressure fluidly connected to the motive passageway, a device requiring vacuum fluidly connected to the suction passageway, and atmospheric pressure fluidly connected to the discharge passageway. Atmospheric pressure is less than the boost pressure.

DETAILED DESCRIPTION

Figure 1A:
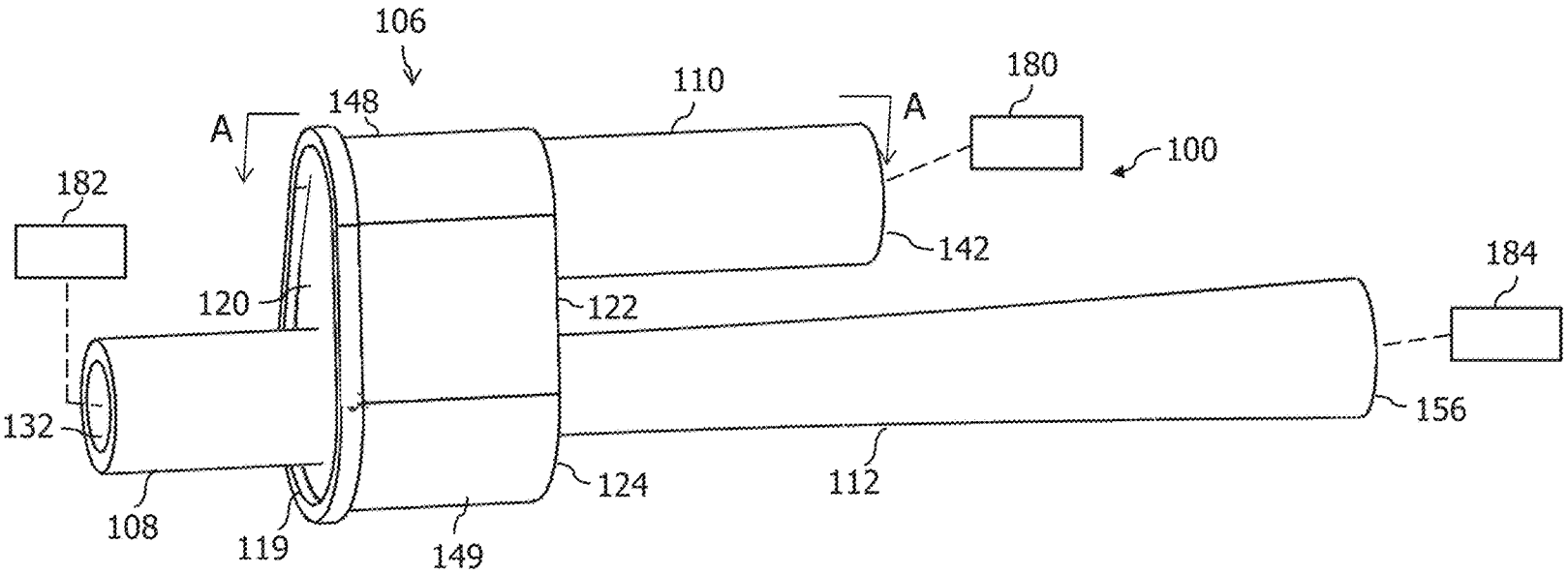
FIG. 1A is a side, perspective view of a device that generates vacuum using the Venturi effect.
Figure 1B:
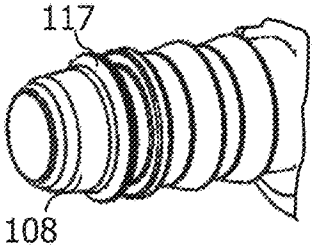
FIG. 1B is a side, perspective view of just the inlet end of the motive port of an alternate embodiment of the device of FIG. 1A.

The following detailed description will illustrate the general principles of the invention, examples of which are additionally illustrated in the accompanying drawings. In the drawings, like reference numbers indicate identical or functionally similar elements, even when the first digit is different, for example, reference 100 and reference 200 distinguishing a first embodiment from a second embodiment.

As used herein, "fluid" means any liquid, suspension, colloid, gas, plasma, or combinations thereof.

FIGS. 1A-4 illustrate different views of a device 100 for producing vacuum using a Venturi effect. The device 100 may be used in an engine, for example, in a vehicle's engine (an internal combustion engine) to provide vacuum to a device requiring vacuum, such as a vehicle brake boost device, positive crankcase ventilation system, a fuel vapor canister purge device, a hydraulic and/or pneumatic valve, etc. Device 100 includes a housing 106 defining a suction chamber 107 in fluid communication with passageway 104 (FIG. 2), which extends from the motive entrance 132 of the motive port 108 to the discharge exit 156 of the discharge port 112. The device 100 has at least three ports that are connectable to an engine or components connected to the engine. The ports include: (1) a motive port 108; (2) a suction port 110, which can connect via an optional check valve (not shown) to a device requiring vacuum 180; and (3) a discharge port 112. Each of these ports 108, 110, and 112 may include a connector feature 117 on an outer surface thereof for connecting the respective port to a hose or other component in the engine, as shown in FIG. 1B for the motive port 108.

Figure 2:
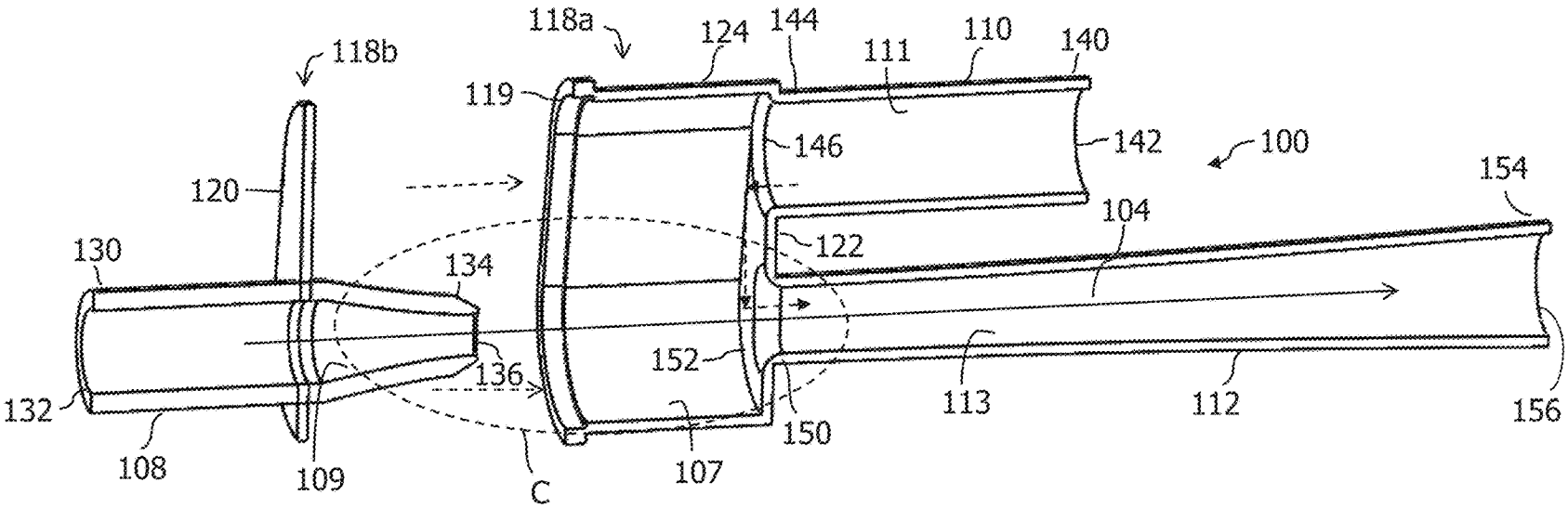
FIG. 2 is a side, longitudinal, exploded cross-sectional view of the device of FIG. 1 taken along line A-A.

Referring now to FIGS. 1A and 2, the housing 106 defining the suction chamber 107 includes a first end wall 120 proximate the motive port 108, a second end wall 122 proximate the discharge port 112 and at least one side wall 124 extending between the first and second end walls 120, 122. The suction chamber when viewed in a transverse cross-section may be generally pear-shaped, i.e., having a rounded top 148 and rounded bottom 149 where the rounded top is narrower than the rounded bottom. As shown in FIG. 2, the suction chamber 107 may be a two-part construction having a container 118*a* and a lid 118*b*, where the lid 118*b* seats within or against a rim 119 of the container 118*a* with a fluid-tight seal. Here, the container 118*a* includes the suction port 110 and the discharge port 112 and the lid 118*b* includes the motive port 108, but is not limited thereto. In another embodiment, the container could include the motive port and the lid could include the suction port and the discharge port.

Still referring to FIG. 2, the motive port 108 defines a motive passageway 109 converging toward the suction chamber 107 and in fluid communication therewith, the discharge port 112 defines a discharge passageway 113 diverging away from the suction chamber 107 and in fluid communication therewith, and the suction port 110 defines a suction passageway 111 in fluid communication with the suction chamber 107. These converging and diverging sections gradually, continuously taper along the length of at least a portion of the interior passageway 109, 111, or 113. The motive port 108 includes an inlet end 130 having a motive entrance 132 and an outlet end 134 having a motive exit 136. Similarly, the suction port 110 includes an inlet end 140 having a suction entrance 142 and an outlet end 144 having a suction exit 146, wherein both the motive exit 136 and the suction exit 146 exit into the suction chamber 107. The discharge port 112 includes an inlet end 150, proximate the suction chamber 107, having a discharge entrance 152, and an outlet end 154, distal from the suction chamber 107, having a discharge exit 156. As illustrated in FIG. 2, the suction passageway 111 enters the suction chamber 107 at a position that generates about a 180 degree change in the direction of the suction flow from the suction passageway 111 to the discharge passageway 113. Accordingly, the suction port 110 is generally parallel to the discharge port 112.

Figure 4A:
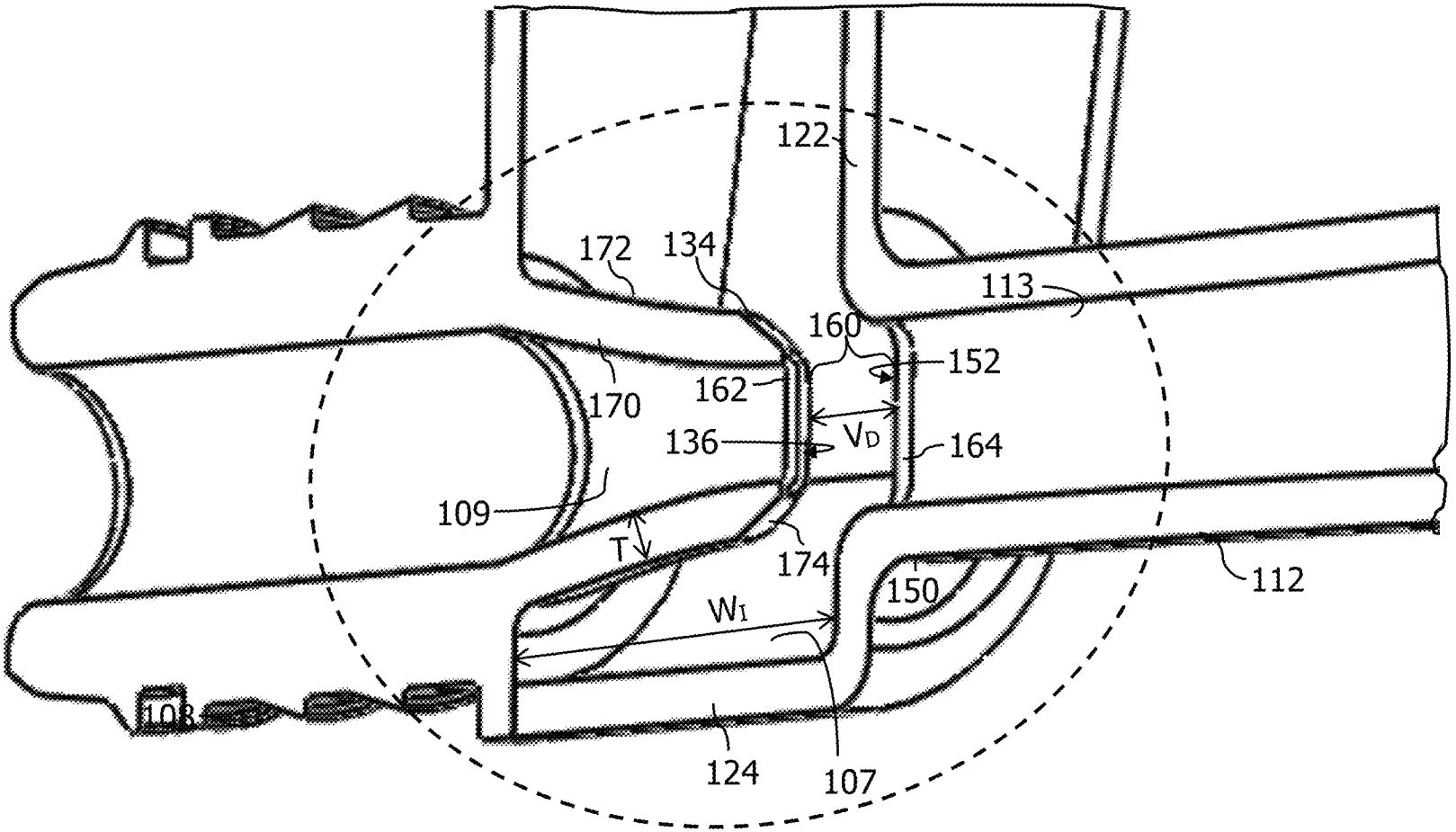
FIG. 4A is an enlarged, side, cross-sectional perspective view of the portion of the device of FIG. 1 inside the dashed oval.
Figure 4B:
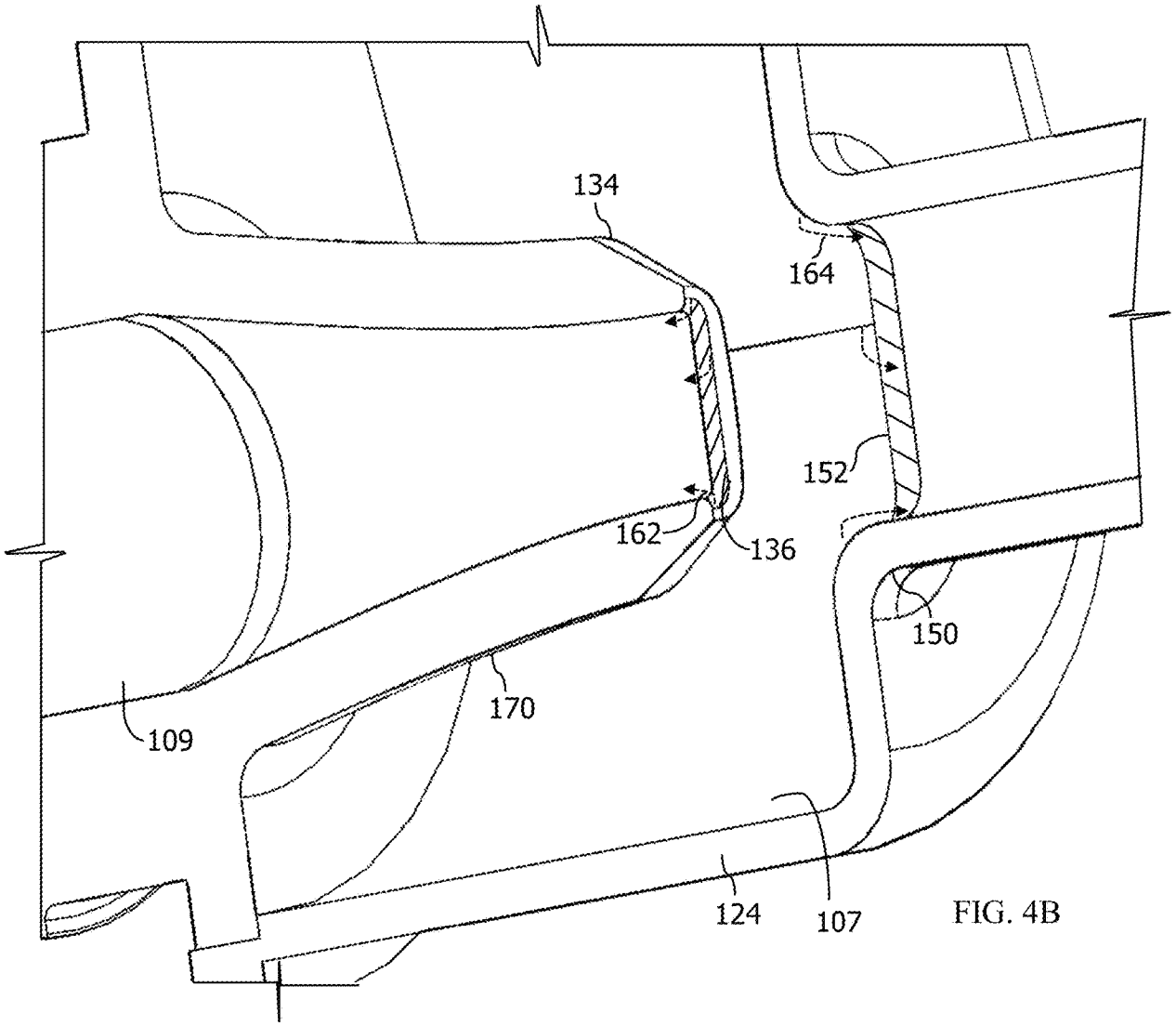
FIG. 4B is a further enlargement of the outlet end 134 and the inlet end 150 to emphasize the corner radii 162, 164.
Figure 5:
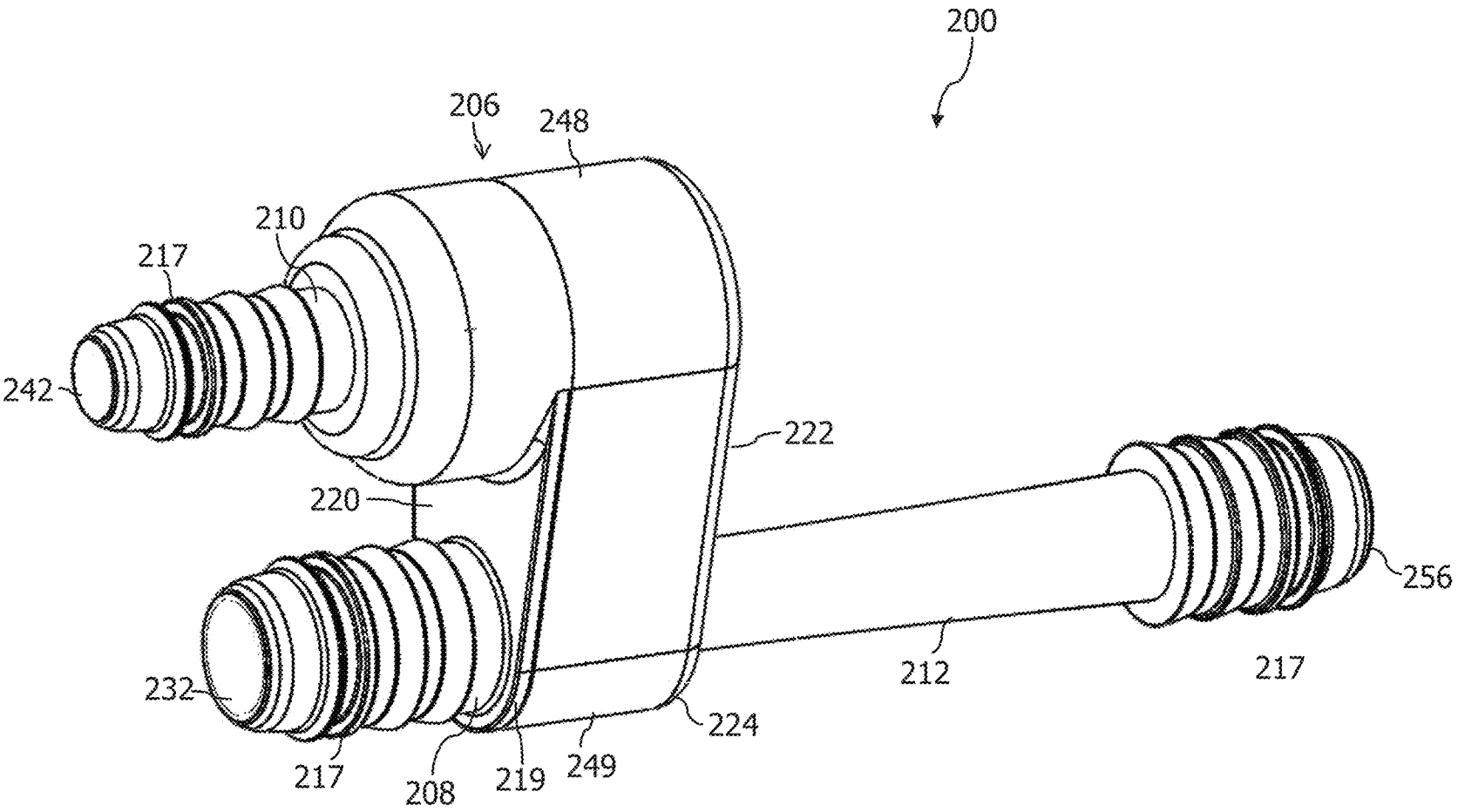
FIG. 5 is a side, perspective view of a device that generates vacuum using the Venturi effect and includes a solenoid valve.

In the assembled device 100, in particular, within the suction chamber 107, as shown in FIG. 4, the outlet end 134 of the motive passageway 109, more specifically, the motive exit 136, is generally aligned with and spaced apart from the discharge entrance 152 at the inlet end 150 of the discharge passageway 113 to define a Venturi gap 160. The Venturi gap 160, as used herein, means the lineal distance $V_D$ between the motive exit 136 and the discharge entrance 152. The motive exit 136 has a first corner radius 162 inside the motive passageway 109, and the discharge entrance 152 is generally flush with the second end wall 122 of the suction chamber 107 and transitions thereto with a second corner radius 164 that is larger than the first corner radius 162. These corner radii 162, 164 are advantageous because not only does the curvature influence the direction of flow, it also helps to maximize the overall entrance and exit dimensions.

Figure 3:
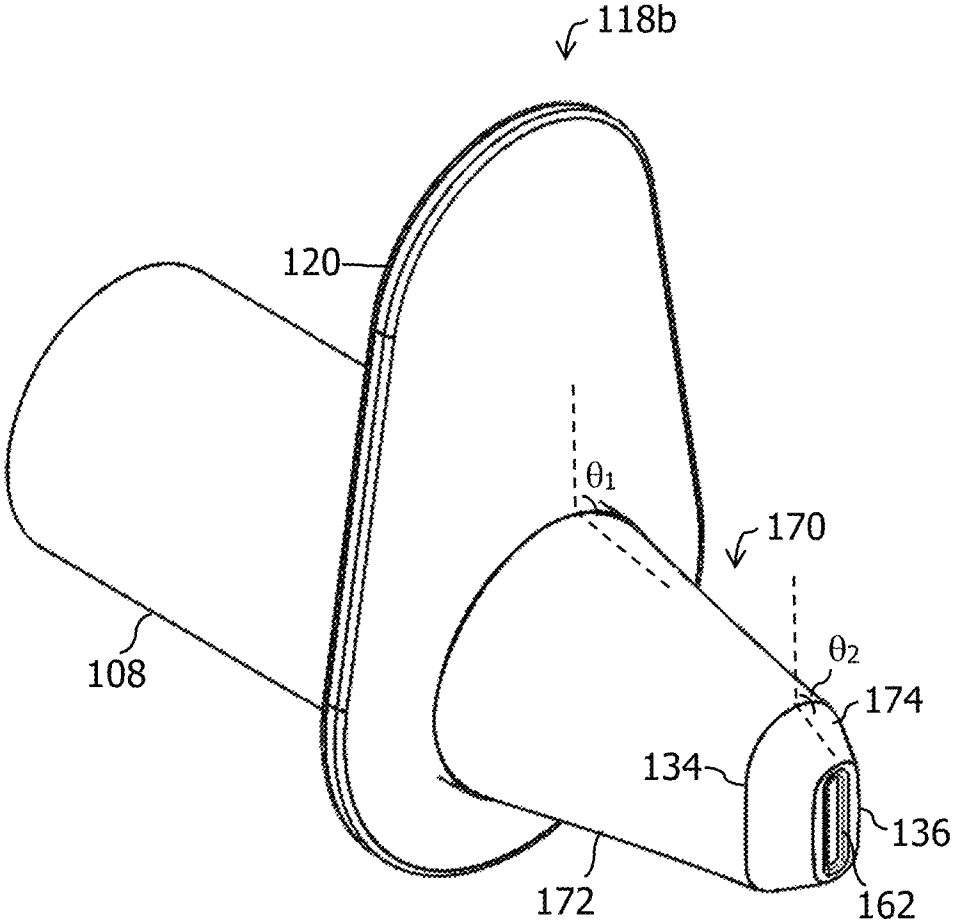
FIG. 3 is a side, perspective view, generally from the motive exit end, of the motive port portion of the device of FIG. 1.

Referring to FIGS. 2-4, the motive passageway 109 terminates in a spout 170 protruding into the suction chamber 107, which has an internal width $W_1$ as labeled in FIG. 4 of about a 10 mm to about a 25 mm, or more preferably about 15 mm to about 20 mm. The spout 170 is disposed spaced apart from all one or more sidewalls 124 of the suction chamber 107, thereby providing suction flow around the entirety of an exterior surface 172 of the spout 170. The exterior surface 172 is generally frustoconical and converges toward the outlet end 134 of the motive passageway 109 with a first converging angle $\theta_1$ (labeled in FIG. 3). The exterior surface 172 may transition into a chamfer 174 more proximate the outlet end 134 than the first end wall 120. The chamfer 174 has a second converging angle $\theta_2$ that is greater than the first converging angle $\theta_1$. The chamber 174 as shown in FIG. 3 changes the generally circular frustoconical exterior surface 172 to a generally more rounded-rectangular or elliptical frustoconical shape. The bottom of the suction chamber 107 below the spout 170 may have a generally rounded interior bottom. The shape of the exterior surface 172, and/or the chamfer 174, and the interior bottom of the suction chamber 107 is advantageous to direct suction flow toward the discharge entrance 152 and do so with minimal disturbance/interference in the flow.

The spout 170 has a wall thickness T that may be about 0.5 mm to about 5 mm, or about 0.5 to about 3 mm, or about 1.0 mm to about 2.0 mm depending upon the material selected for the construction of the device 100.

Also, as best seen in FIG. 4, the cross-sectional area of the motive exit 136 is smaller than the cross-sectional area of the discharge entrance 152, this difference is referred to as the offset. The offset of the cross-sectional areas may vary depending upon the parameters of the system into which the device 100 is to be incorporated. In one embodiment, the offset may be in the range of about 0.1 mm to about 2.0 mm, or more preferably in a range of about 0.3 mm to about 1.5 mm. In another embodiment, the offset may be in the range of about 0.5 m to about 1.2 mm, or more preferably in a range of about 0.7 to about 1.0 mm.

When device 100 is for use in a vehicle engine, the vehicle manufacturer typically selects the size of both the motive port 108 and discharge port 112 based on the tubing/hose size available for connection of the aspirator to the engine or components thereof. Additionally, the vehicle manufacturer typically selects the maximum motive flow rate available for use in the system, which in turn will dictate the area of the interior opening defined at the motive outlet end 134, i.e., the motive exit 136. Working within these constraints, the disclosed devices 100 significantly reduce the compromise between the desire to produce high suction flow rates at moderate motive flow rates provided under boost conditions of an engine. This reduction in the compromise is accomplished by changing the configuration of the orientation of the suction port 110, the suction chamber 107, including its internal width and shape, the spout of the motive port 108, the offset of the motive exit and the discharge entrance, adding the corner radii to the motive exit and/or the discharge entrance, and varying the Venturi gap $V_D$.

In operation, the device 100, in particular the suction port 110, is connected to a device requiring vacuum (see FIG. 1), and the device 100 creates vacuum for said device by the flow of fluid, typically air, through passageway 104, extending generally the length of the device, and the Venturi gap 160 (labeled in FIG. 4) defined thereby within the suction chamber 107. In one embodiment, the motive port 108 is connected for fluid communication of its motive passageway with a source of boost pressure and the discharge passageway is connected for fluid communication of its discharge passageway with atmospheric pressure, which is less than the boost pressure. In such an embodiment, the device 100 may be referred to as an "ejector." In another embodiment, the motive port 108 may be connected to atmospheric pressure and the discharge port may be connected to a source of pressure that is less than atmospheric pressure. In such an embodiment, the device 100 may be referred to as an "aspirator." The flow of fluid (e.g., air) from the motive port to the discharge port draws the fluid down the motive passageway, which can be a straight cone, a parabolic profile, or a hyperbolic profile, as described herein. The reduction in area causes the velocity of the air to increase. Because this is an enclosed space the laws of fluid mechanics state that the static pressure must decrease when the fluid velocity increases. The minimum cross sectional area of the converging motive passageway abuts the Venturi gap. As air continues to travel to the discharge port, it travels through the discharge entrance and diverging discharge passageway, which is either a straight cone, a parabolic profile, or a hyperbolic profile. Optionally, the discharge passageway can continue as a straight, parabolic profile, or hyperbolic profile cone until it joins the discharge exit, or it can transition to a simple cylindrical or tapered passage before reaching the discharge exit.

In a desire to increase the flow rate of air from the suction port 110 into the Venturi gap 160, the area of the Venturi gap is increased by increasing the perimeter of the discharge entrance 152 without increasing the overall inner dimension of the first motive passageway 109 (preferably with no increase in the mass flow rate). In particular, the motive exit 136 and the discharge entrance 152 are non-circular as explained in co-owned U.S. patent application Ser. No. 14/294,727, filed on Jun. 3, 2014 because a non-circular shaped having the same area as a passageway with a circular cross-section is an increase in the ratio of perimeter to area. There are an infinite number of possible shapes that are not circular, each with a perimeter and a cross sectional area. These include polygons, or straight line segments connected to each other, non-circular curves, and even fractal curves. To minimize cost a curve is simpler and easy to manufacture and inspect, and has a desirable perimeter length. In particular, elliptical- or polygonal-shaped embodiments for the internal cross-sections of the motive and discharge passageways are discussed in the co-owned application referred to above. This increase in perimeter, which is further enhanced by the first corner radius of the motive exit and the second corner radius of the discharge entrance disclosed herein, will again provide the advantage of increasing the intersection area between the Venturi gap and the suction port, resulting in an increase in suction flow.

So, as shown in FIG. 2, the motive passageway 109 and the discharge passageway 113 both converge in cross-sectional area toward the suction chamber 107 as a hyperbolic or parabolic function. The motive entrance 132 and the discharge exit 156 may be the same shape or different and may be generally rectangular, elliptical or circular. In FIGS. 1A and 2, motive entrance 132 and the discharge exit 156 are depicted as circular, but the motive exit 136 and the discharge entrance 152, i.e., the interior shape of each opening, are rectangularly- or elliptically-shaped. Other polygonal shapes are also possible, and the devices should not be interpreted to be limited to rectangular or elliptical interior shapes.

Figure 11:
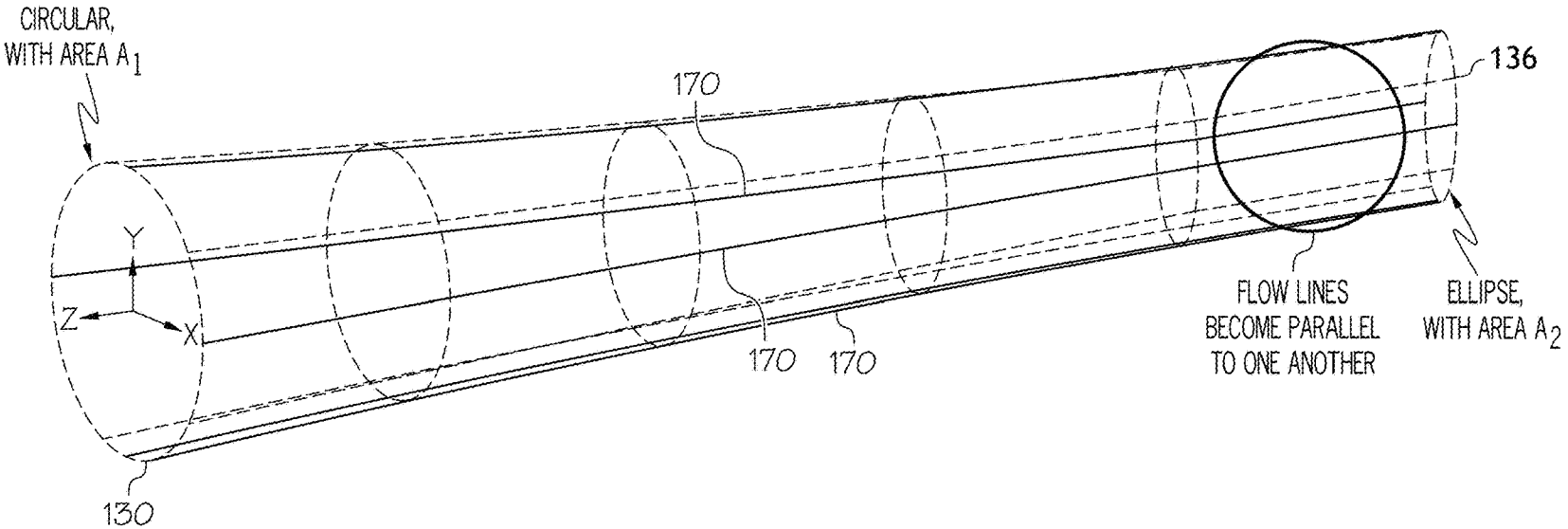
FIG. 11 PRIOR ART
FIG. 11 is a model of the internal passageway within the motive section.

The interior of the motive passageway 109 and/or the discharge passageway may be constructed to have the same general shape. For example, the shape illustrated in FIG. 11 herein, which is from co-pending application Ser. No. 14/294,727, begins at the motive inlet end 130 as a circular opening having an area $A_1$ and gradually, continuously transitions, as a hyperbolic function, to an ellipse opening at the motive exit 136 that has an area $A_2$, which is smaller than $A_1$. The circular opening at the motive inlet end 130 is connected to the ellipse-shaped motive exit 136 by hyperbola lines that provide the advantage of flow lines at the motive exit 136 being parallel to one another.

The suction passageway 111 defined by the suction port 110 may be a generally cylindrical passage of constant dimension(s) as shown in FIG. 1, or it may gradually, continuously taper as a cone or according to a hyperbolic or parabolic function along its length converging toward the suction chamber 107.

Referring now to FIGS. 5-9, a second device for producing vacuum using a Venturi effect, generally designated 200, is illustrated that has the same or similar features as described above for the embodiment disclosed in FIGS. 1A-4. Device 200 differs from device 100 in the inclusion of a solenoid valve 260 to control the flow of fluid through the suction port 210. Features described above that are repeated in FIGS. 5-9 have the same numbers other than they begin with a "2," and as such, an explanation of these features is not duplicated below.

Figure 6:
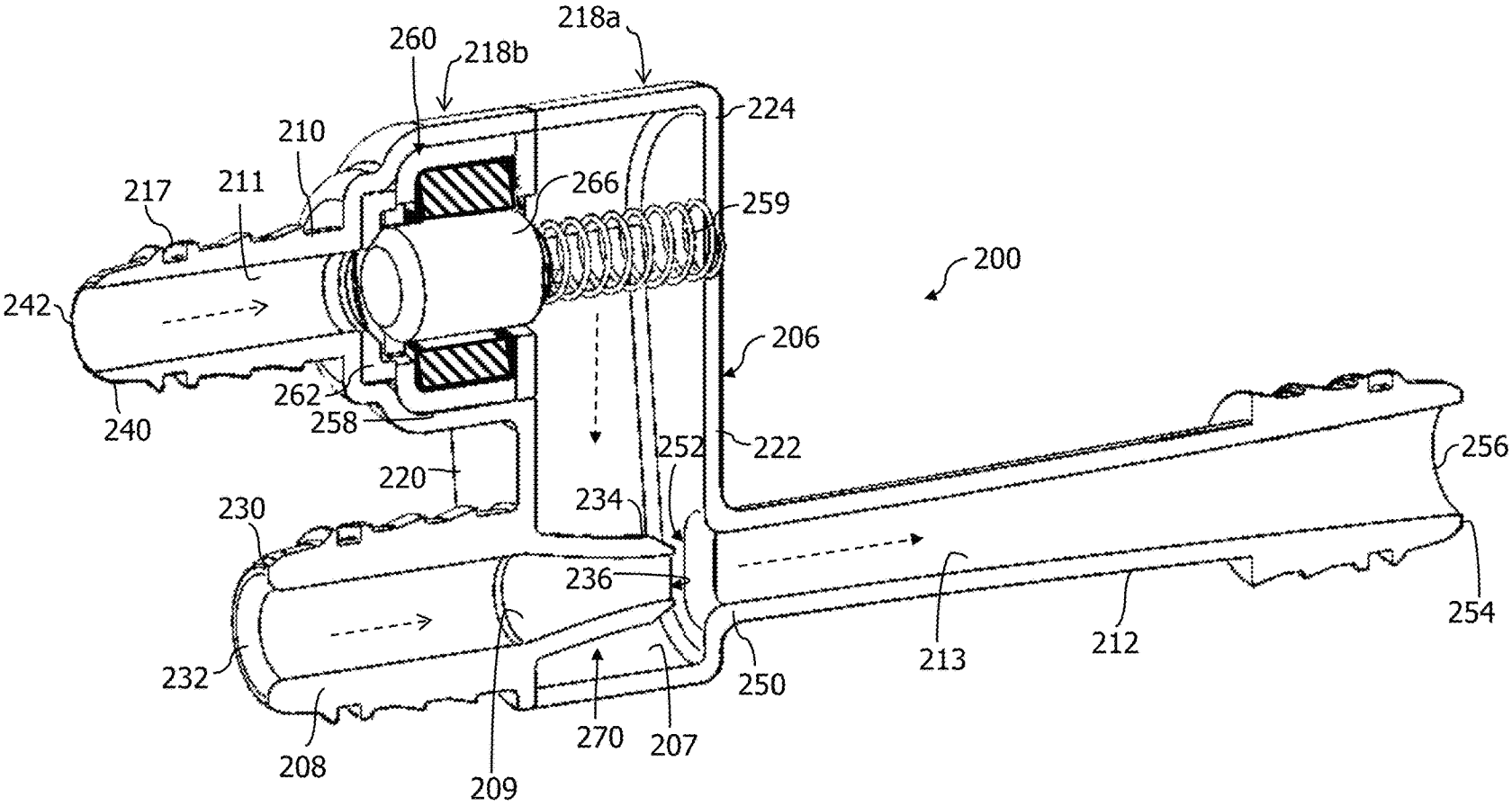
FIG. 6 is a side, longitudinal cross-sectional view of the device of FIG. 5.

The solenoid valve 260 is seated within the suction passageway 211 to control the flow of fluid therethrough. The solenoid valve 260 may be seated in a receptacle 258 defined in the lid 218*b*, in the container 218*a*, or in a portion of both thereof and includes a spring 259 seated within the chamber 207, in particular against the interior surface of the second end wall 222, and connected to a sealing member 266 of the solenoid valve 260. In FIG. 6, the solenoid valve 260 is seated in a receptacle 258 defined in the lid 218*b*. The receptacle 258 has a seal seat integral therewith or a seal seat 262 mounted therein to mate a sealing member 266 of the solenoid valve 260 therewith in a fluid-tight engagement. The seal seat 262 defines a bore 274 (see FIG. 7) therethrough in fluid alignment with the suction passageway 211. The bore 274 is smaller than the bore 278 in a first core 264 of the solenoid valve 260 to seal the suction passageway 211 when the solenoid valve is in a closed position. The seal seat 262 may also include a contoured or beveled face 276 that the sealing member 266 seats against.

Figure 7:
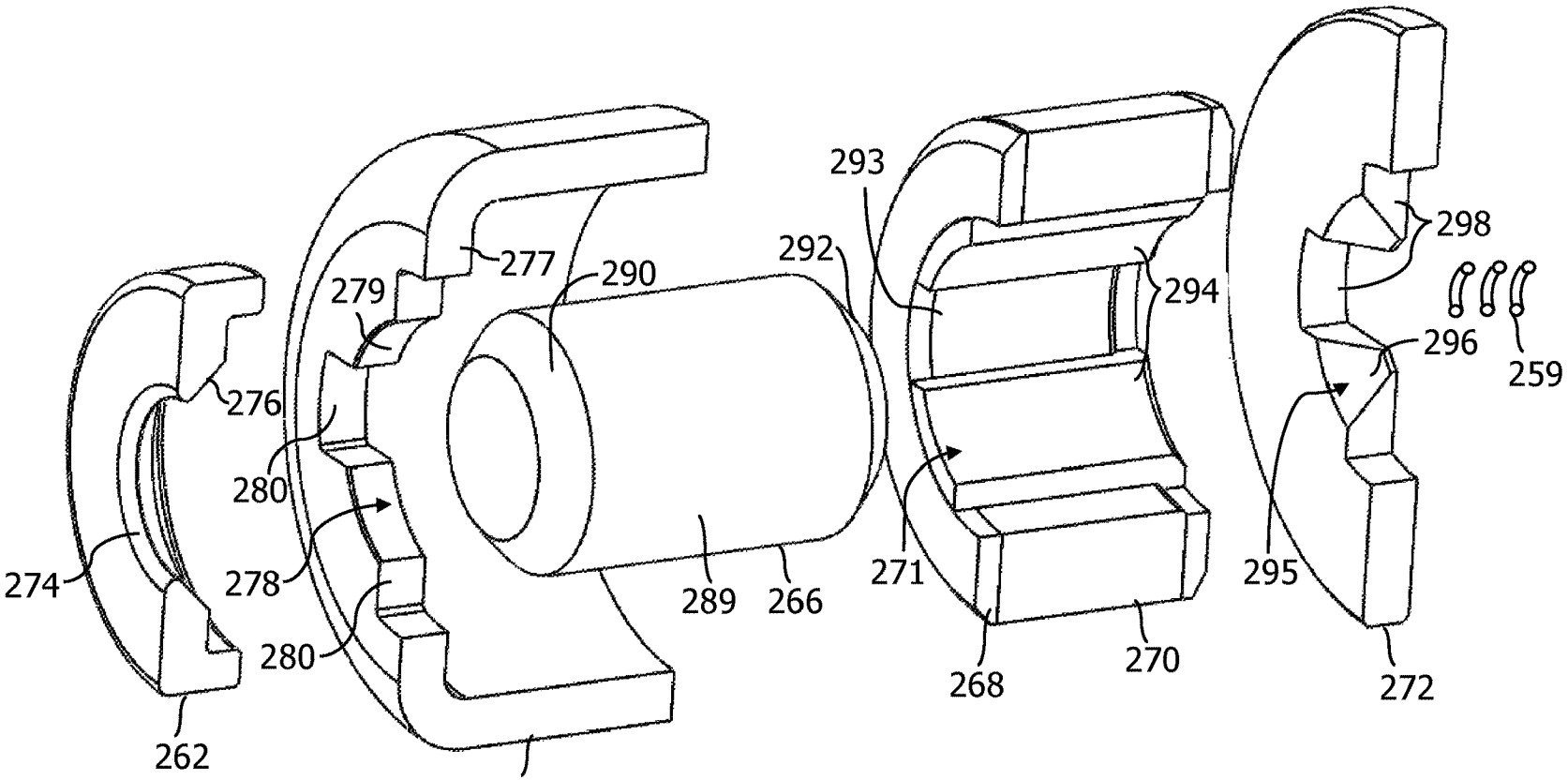
FIG. 7 is an exploded cross-sectional view of the solenoid valve found in the device of FIG. 6.
Figure 9:
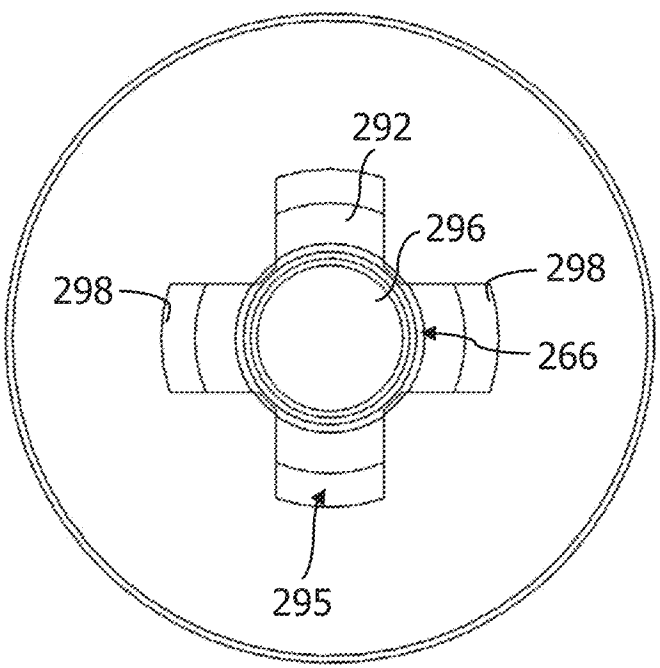
FIG. 9 is a bottom plan view of the solenoid valve found in the device of FIGS. 5 and 6.
Figure 8:
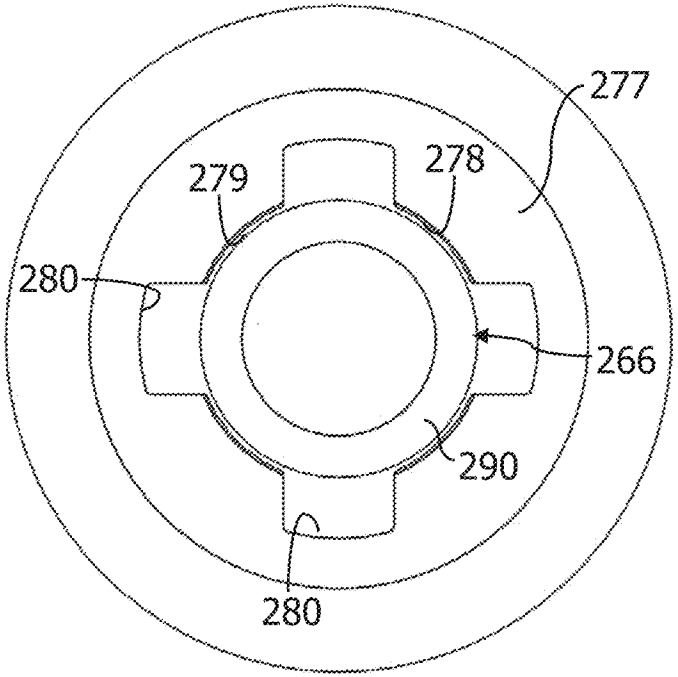
FIG. 8 is a top plan view of the solenoid valve found in the device of FIGS. 5 and 6.

The solenoid valve 260, from left to right in FIG. 7, includes a first core 264, the sealing member 266, a coil 270 wound on a bobbin 268, and a second core 272. The first core 264, the second core 272, and the sealing member 266 are all made from materials that readily conduct magnetic flux. The first core 264 is generally cup-shaped having a bottom 277 defining a bore 278 therethrough. The bore 278 includes a sealing member-receiving portion 278 having a diameter larger than an outer dimension or outer diameter of the sealing member 266, such that the sealing member 266 is translatable at least partially therethrough into and out of engagement with the seal seat 262, and a plurality of flow channels 280 radiating radially outward from the sealing member-receiving portion 278, which may be best illustrated in FIG. 8. The flow channels 280 enable fluid flow around the sealing member 266 and into the chamber 207 defined by the housing 206. The second core 272 is generally a planar disk mateable to the first core 264 to define a housing for the sealing member 266 and the coil 270 wound on the bobbin 268. In another embodiment, the first core may be a generally planar disk and the second core may be generally cup-shaped. In another embodiment, the first and second cores may each be generally cup-shaped and mate together to define a housing. In another embodiment, there may be two generally flat cores, one made as 272, the other made as the bottom of 264, and a third member being a generally cylindrical part shaped like the axial portion of 264.

Figure 10:
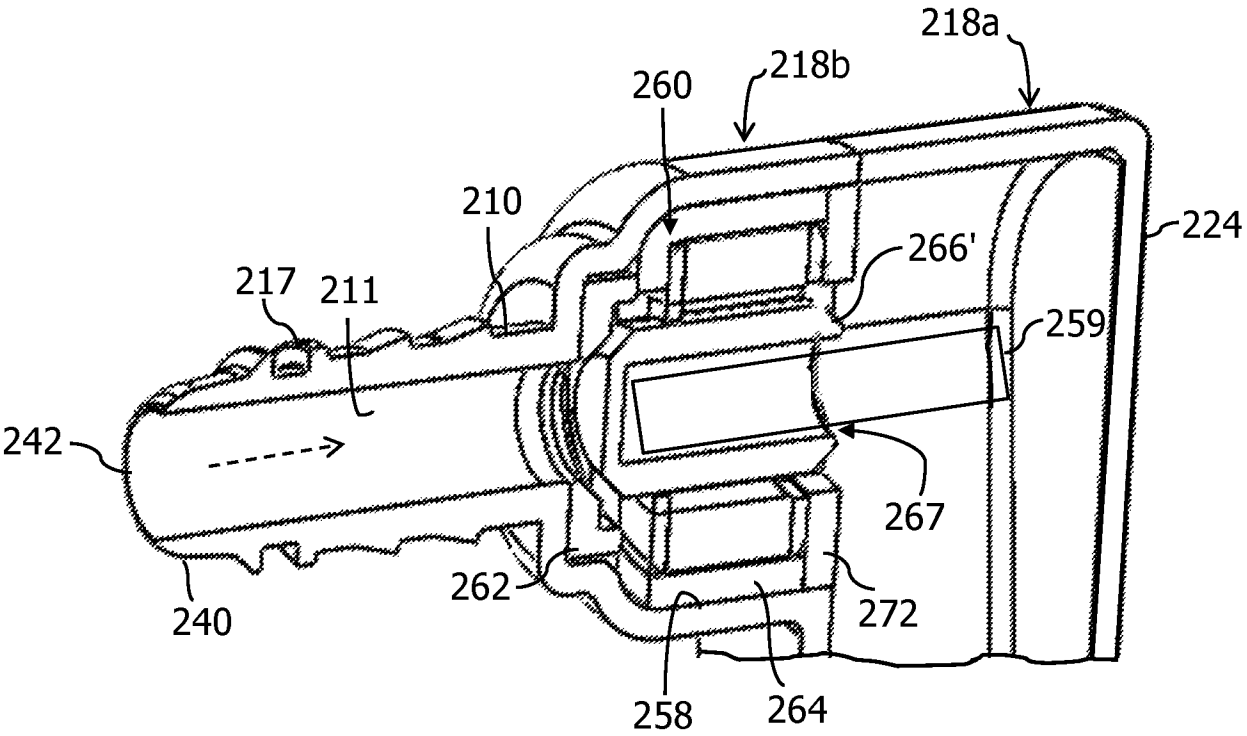
FIG. 10 is a partial, side, longitudinal cross-sectional view of an alternate embodiment of a solenoid valve portion of the device of FIG. 5.

The second core 272 defines a bore 295 therethrough. The bore 295 includes a sealing member-seat portion 296 having a diameter similar to the outer dimension of the sealing member 266 and larger than an outer diameter of a spring 259, and a plurality of flow channels 298 radiating radially outward from the sealing member-seat portion 296, which may be best illustrated in FIG. 9. The sealing member-seat portion 296 may be contoured or beveled to receive a mating portion of the sealing member 266 thereagainst. In one embodiment, the sealing member-seat portion 296 defines a generally conical receptacle. The spring 259 is connected to the sealing member 266 and biases the sealing member 266 into engagement with the seal seat 262 for the closed position. As shown in FIG. 6, the sealing member 266 is a solid body with a first end of the spring 259 seated against an end of the sealing member 266. However, as shown in an alternate embodiment in FIG. 10, the sealing member 266' is hollow inside (i.e., defines a hollow core 267) and receives the first end of the spring 259 in the hollow core 267. In both embodiments, the flow channels 298 enable fluid flow around the sealing member 266, 266' into the chamber 207 defined by the housing 206. For maximum fluid flow through the solenoid valve 260, the flow channels 280 in the first core 264 and the flow channels 298 in the second core 272 are aligned with one another.

The bobbin 268 defines a core 271 in which the sealing member 266 is disposed and is translatable. The core 271 may define flow channels 293 between spaced apart guide members 294 defining the core of the bobbin. The guide members 294 are oriented parallel to the longitudinal axis of the sealing member 266 and guide the sealing member 266 as it is translated between the open position and the closed position. Hereto, for maximum fluid flow through the solenoid valve 260, the flow channels 293 are aligned with the flow channels 280 in the first core 264 and with the flow channels 298 in the second core 272. The coil 270 wound on the bobbin 268 is connected to electrical connectors (not shown) that are connectable to a source of electric current to activate the solenoid valve 260. The electrical connectors provide engine designers a plethora of options for control of the suction flow (vacuum) generated by the device 200.

With reference to the sealing member 266 of FIGS. 6-9, it has a generally elongate body 289 with a contoured first end 290 and a contoured second end 292. The elongate body 289 is cylindrical and the first end 290 has a generally conically-shaped exterior surface that seats against the contoured or beveled face 276 of the seal seat 262. The second end 292 is also a generally conically-shaped exterior surface. The second end 292 seats against the sealing member-seat portion 296 of the second core 272. In one embodiment, the sealing member 266 may be referred to as a pintle. The sealing member 266 is composed of one or more materials providing it with magnetic properties, so that it can be translated to an open position in response to a magnetic flux created by the first and second cores 264, 272.

The solenoid valve 260 of FIG. 6 is normally closed based on the position of the spring 259. When an electrical current is applied to the coil 270, the activated state, a magnetic flux is generated through the first and second cores 264, 272, which moves the sealing member 262 toward and into engagement with the second core 272, in particular with the sealing member-seat portion 296 thereof, which defines the open position.

The addition of the solenoid valve 260 in the device 200 provides the advantage of a simple, inexpensive, compact electrically activated valve to control the suction flow based on selected engine conditions through the use of a controller, such as an automobile's engine computer. This is advantageous over check valves that open and close merely in reaction to pressure changes in the system.

While the solenoid valve 260 as shown in FIG. 6 is a normally closed valve, it is appreciated that the position of the spring could be changed to make this a normally open valve that is closed in response to an electrical signal from a controller.

The devices disclosed herein may be made of a plastic material, except as noted above for component parts of the solenoid valve, or other suitable material(s) for use in a vehicle engine, one that can withstand engine and road conditions, including temperature, moisture, pressures, vibration, and dirt and debris, and may be made by injection molding or other casting or molding processes.

Although the invention is shown and described with respect to certain embodiments, it is obvious that modifications will occur to those skilled in the art upon reading and understanding the specification, and the present invention includes all such modifications.

What is claimed is:

1. A device for producing vacuum using the Venturi effect comprising:

a housing defining a suction chamber, a motive passageway converging toward the suction chamber and in fluid communication therewith, a discharge passageway defining a discharge entrance at the suction chamber and diverging away from the suction chamber beginning at the discharge entrance and in fluid communication therewith, and a suction passageway in fluid communication with the suction chamber; and a solenoid valve in the suction passageway controlling fluid flow into the suction chamber, the solenoid valve comprising;

an elongate sealing member received inside a bobbin having a coil wound thereon, the bobbin and the coil are seated inside a core, wherein the core and the bobbin collectively define a plurality of fluid channels around the exterior surface of the elongate sealing member;

a spring seated against an interior wall of the suction chamber and in operative engagement with the elongate sealing member; and a seal seat defining a closed position and an opposing seat defining an open position;

wherein the elongate sealing member is translatable within the coil between the open position and the closed position;

wherein within the suction chamber a motive exit of the motive passageway is aligned with and spaced apart from the discharge entrance of the discharge passageway by a lineal distance ($V_D$) to define a Venturi gap.

2. The device of claim 1, wherein the motive passageway and the discharge passageway both diverge in cross-sectional area away from the suction chamber as a hyperbolic or parabolic function.

3. The device of claim 1, wherein the bobbin has spaced apart guide members defining flow channels oriented parallel to the longitudinal axis of the sealing member.

4. The device of claim 1, wherein the solenoid valve is in a normally closed position.

5. The device of claim 1, wherein the suction passageway is disposed parallel to the discharge passageway.

6. A device for producing vacuum using the Venturi effect comprising:

a housing defining a suction chamber, a motive passageway converging toward the suction chamber and in fluid communication therewith, a discharge passageway diverging away from the suction chamber and in fluid communication therewith, and a suction passageway in fluid communication with the suction chamber; and a solenoid valve in the suction passageway controlling fluid flow into the suction chamber, the solenoid valve comprising an elongate sealing member received inside a coil, a first seal seat having a first bore therethrough defining a closed position of the solenoid valve; a first core member defining a second bore aligned with the first bore and through which the elongate sealing member is translatable into engagement with the first seal seat and defining a plurality of flow channels radiating radially outward from the second bore; and a second seat defining an open position at the opposite end of the coil from the first seal seat; wherein the elongate sealing member is translatable within the coil between the first seal seat and the second seat;

wherein the elongate sealing member and the first core member both comprise materials that conduct magnetic flux;

wherein, in the open position, fluid flow is through the first bore, through the plurality of flow channels in the first core member, and around the exterior surface of the elongate sealing member;

wherein within the suction chamber a motive exit of the motive passageway is aligned with and spaced apart from a discharge entrance of the discharge passageway by a lineal distance ($V_D$) to define a Venturi gap.

7. The device of claim 6, wherein the motive passageway and the discharge passageway both diverge in cross-sectional area away from the suction chamber as a hyperbolic or parabolic function.

8. The device of claim 6, wherein the motive exit has a first corner radius around the entire opening inside the motive passageway.

9. The device of claim 8, wherein the discharge entrance is flush with a wall of the suction chamber and transitions thereto with a second corner radius, the second corner radius being larger than the first corner radius.

10. The device of claim 8, wherein the cross-sectional area of the motive exit is smaller than the cross-sectional area of the discharge entrance.

11. The device of claim 6, wherein the motive passageway terminates in a spout protruding into the suction chamber and disposed spaced apart from all one or more sidewalls of the suction chamber thereby providing suction flow around the entirety of an exterior surface of the spout.

12. The device of claim 11, wherein the exterior surface of the spout converges toward an outlet end of the motive passageway with one or more converging angles when viewed in a longitudinal cross-section.

13. The device of claim 11, wherein, when viewed in a cross-section taken transverse to the lineal distance ($V_D$) of the Venturi gap, the suction chamber has a rounded interior bottom below the spout.

14. The device of claim 6, wherein the suction chamber has an internal width within a range of 10 mm to 25 mm.

15. The device of claim 6, wherein the solenoid valve is in a normally closed position.

16. The device of claim 6, wherein the suction passageway is disposed parallel to the discharge passageway.

17. The device for producing vacuum using the Venturi effect of claim 16, wherein the suction passageway enters the suction chamber at a position that generates a 180 degree change in the direction of suction flow from the suction passageway to the discharge passageway.

18. A system comprising:

a device for producing vacuum using the Venturi effect as set forth in claim 6;

a source of boost pressure fluidly connected to the motive passageway;

a device requiring vacuum fluidly connected to the suction passageway; and a source of pressure less than the boost pressure fluidly connected to the discharge passageway.

19. The device for producing vacuum using the Venturi effect of claim 6, further comprising a bobbin having the coil wound thereon and defining a core in which the sealing member is disposed; wherein the bobbin has spaced apart guide members defining flow channels oriented parallel to the longitudinal axis of the sealing member and aligned one each with the plurality of fluid channels in the first core for fluid flow around the exterior surface of the elongate sealing member.

20. The device for producing vacuum using the Venturi effect of claim 6, further comprising a spring seated against an interior wall of the suction chamber and in operative engagement with the elongate sealing member.

* * * * *